US005619773A

United States Patent [19]

Göhler et al.

[11] Patent Number: 5,619,773

[45] Date of Patent: Apr. 15, 1997

[54] DRAW FRAME

[75] Inventors: Wolfgang Göhler; Rudolf Becker, both of Ingolstadt; Michael Strobel, Eichstätt, all of Germany

[73] Assignee: Rieter Ingolstadt Spinnereimaschinenbau AG, Ingolstadt, Germany

[21] Appl. No.: 633,708

[22] Filed: Apr. 17, 1996

Related U.S. Application Data

[63] Continuation of Ser. No. 184,490, Jan. 21, 1994, abandoned.

[30] Foreign Application Priority Data

Jan. 25, 1993 [DE] Germany ..... 43 01 953.6

[51] Int. Cl.[6] ..... D01H 5/56

[52] U.S. Cl. ..... 19/294; 19/260

[58] Field of Search ..... 19/236, 258, 260, 19/261, 294, 295

[56] References Cited

U.S. PATENT DOCUMENTS

| | | |
|---|---|---|
| 4,847 | 11/1846 | Pray et al. . |
| 7,165 | 3/1850 | Hayden . |
| 7,919 | 1/1851 | Wyllys . |
| 68,741 | 9/1867 | Herrschaft . |
| 86,719 | 2/1869 | Whitton . |
| 110,556 | 12/1870 | Draper . |
| 117,098 | 7/1871 | Moon . |
| 164,452 | 6/1875 | Herschaft . |

(List continued on next page.)

FOREIGN PATENT DOCUMENTS

| | | |
|---|---|---|
| 1195177 | 11/1959 | France . |
| 1237428 | 6/1960 | France . |
| 720200 | 4/1942 | Germany . |
| 1097328 | 1/1961 | Germany . |
| 1287484 | 9/1969 | Germany . |
| 2331217 | 1/1975 | Germany . |
| 2630224 | 1/1978 | Germany . |
| 2656537 | 6/1978 | Germany . |
| 2705553 | 8/1978 | Germany . |
| 4000814C1 | 5/1991 | Germany . |

(List continued on next page.)

OTHER PUBLICATIONS

European Search Report with Translation.

"A Survey of Autolevelling at the Drawframe" by David J. Goetzinger, Dec. 1, 1976.

"Design, Construction, and Performance of Saco–Lowell/ Uster Versa–Matic ADC Draw Frame", by Paul B. West, Jun. 1, 1960.

"Saco–Lowell Uster Versamatic Automatic Draw Frame Draft Control".

"Platt Group Bulletin" vol. 11, No. 3, Autolevelling at the Drawframe.

"Automatic Eveners: What They Do, How They Work" by Dr. Hugh M. Brown, Textile World, Feb., 1966.

"Simulation of a Textile Machine Process Control System", Atomic Weapons Research Establishment Awre Report No. 0–71/66, by K.G. Beauchamp, Oct., 1966.

"Draw Frame with Servo Controlled Draft" Saco–Lowell Shops, Boston, U.S.A.

Electronics in Textile Machines—Carding Machine Control, Industrial Electronics, May, 1965.

*Primary Examiner*—Michael A. Neas
*Attorney, Agent, or Firm*—Dority & Manning

[57] ABSTRACT

The instant invention relates to a process for the adjustment of a drafting unit of a draw frame. The drafting unit is equipped with drafting rollers (5, 5') supported in a pillow block (4, 4'). The pillow block (4, 4') is installed on a table (10). The height of the table (10) is adjusted by a first set of adjusting devices and the pitch of the table (10) is adjusted by a second set of adjusting device in relation to the frame (2). The table (10) is installed between the pillow block (4, 4') and the frame (2) for the positional adjustment of the pillow block (4, 4').

15 Claims, 4 Drawing Sheets

U.S. PATENT DOCUMENTS

| | | | |
|---|---|---|---|
| 216,630 | 6/1879 | Reilley . | |
| 278,488 | 5/1883 | Ayers . | |
| 284,585 | 9/1883 | Whitehead . | |
| 352,701 | 11/1886 | Matteson . | |
| 387,701 | 8/1888 | Upton . | |
| 389,695 | 9/1888 | Evans . | |
| 392,172 | 10/1888 | Wilkins . | |
| 447,200 | 2/1891 | Peirce . | |
| 449,477 | 3/1891 | Hildreth . | |
| 466,410 | 1/1892 | Hadfield . | |
| 565,084 | 8/1896 | Mathewson . | |
| 655,934 | 8/1900 | Mathewson . | |
| 690,596 | 1/1902 | Mathewson . | |
| 786,242 | 3/1905 | Westcott et al. . | |
| 887,281 | 5/1908 | Smith . | |
| 1,111,290 | 9/1914 | Birch et al. . | |
| 1,130,880 | 3/1915 | Blackwood | 19/294 |
| 1,132,316 | 3/1915 | Eves . | |
| 1,876,376 | 9/1932 | Wilkinson | 19/294 |
| 2,141,003 | 3/1938 | King et al. . | |
| 2,407,100 | 9/1946 | Richardson . | |
| 2,446,021 | 7/1948 | Noguera | 19/260 |
| 2,681,475 | 6/1954 | Raper . | |
| 2,728,111 | 12/1955 | Werth et al. | 19/294 |
| 2,746,093 | 5/1956 | Raper . | |
| 2,749,575 | 6/1956 | Toenniessen | 19/294 |
| 2,810,936 | 10/1957 | Altenburger . | |
| 2,890,494 | 6/1959 | Raper . | |
| 2,891,287 | 6/1959 | Raper . | |
| 2,930,084 | 3/1960 | Sanborn et al. . | |
| 2,950,508 | 8/1960 | Locher . | |
| 2,964,803 | 12/1960 | Robinson . | |
| 2,981,986 | 5/1961 | Neil . | |
| 3,016,460 | 1/1962 | Andresen . | |
| 3,079,647 | 3/1963 | Butler | 19/294 |
| 3,099,048 | 7/1963 | Locher . | |
| 3,113,350 | 12/1963 | Selby . | |
| 3,244,863 | 4/1966 | Paterson . | |
| 3,246,916 | 4/1966 | Owen . | |
| 3,314,114 | 4/1967 | Wyatt . | |
| 3,440,690 | 4/1969 | Greenwood et al. . | |
| 3,557,615 | 1/1971 | Seymour, Jr. et al. . | |
| 3,703,023 | 11/1972 | Krauss et al. . | |
| 3,768,122 | 10/1973 | Rauch . | |
| 3,795,851 | 3/1974 | Gage et al. . | |
| 3,822,590 | 7/1974 | Tharpe et al. . | |
| 3,827,106 | 8/1974 | Varga . | |
| 3,862,473 | 1/1975 | Felix et al. . | |
| 3,869,759 | 3/1975 | Savageau et al. . | |
| 3,885,232 | 5/1975 | Goto . | |
| 3,925,850 | 12/1975 | Lytton . | |
| 3,938,223 | 2/1976 | Grice . | |
| 4,030,082 | 6/1977 | Goto . | |
| 4,030,635 | 6/1977 | Hablutzel et al. . | |
| 4,051,722 | 10/1977 | Feller . | |
| 4,099,297 | 7/1978 | Hasegawa et al. . | |
| 4,137,487 | 1/1979 | Niestroj et al. . | |
| 4,163,927 | 8/1979 | Grice, Jr. . | |
| 4,369,550 | 1/1983 | Meile . | |
| 4,653,153 | 3/1987 | Felix et al. . | |
| 4,974,296 | 12/1990 | Vidler . | |
| 5,018,248 | 5/1991 | Haworth et al. . | |
| 5,303,454 | 4/1994 | Stahlecker et al. | 19/294 |

FOREIGN PATENT DOCUMENTS

| | | | |
|---|---|---|---|
| 989056 | 3/1975 | Italy . | |
| 401758 | 2/1974 | U.S.S.R. . | |
| 1144 | of 1860 | United Kingdom . | |
| 3962 | of 1873 | United Kingdom . | |
| 779197 | 7/1957 | United Kingdom . | |
| 855949 | 12/1960 | United Kingdom . | |
| 891321 | 3/1962 | United Kingdom . | |
| 979346 | 1/1965 | United Kingdom . | |
| 1135752 | 12/1968 | United Kingdom . | |
| 1186626 | 4/1970 | United Kingdom | 19/294 |
| 1436029 | 5/1976 | United Kingdom . | |
| 1443258 | 7/1976 | United Kingdom . | |

DRAW FRAME

This is a continuation of application Ser. No. 08/184,490, filed Jan. 21, 1994, which was abandoned upon the filing hereof.

BACKGROUND OF THE INVENTION

The instant invention relates to a process for the installation and interconnection of drafting units of a single-head or two-head draw frame, whereby each drafting unit is provided with drafting rollers supported in pillow blocks and with interconnected shafts provided in the case of a two-head draw frame. The invention furthermore relates to a draw frame with a frame having at least one drafting unit placed on the frame on top of pillow blocks.

Single-head draw frames, i.e. draw frames using one single drafting unit for the drafting of fiber slivers, in which the drafting rollers are installed in pillow blocks directly on the frame of the draw frame are known. For the horizontal and vertical alignment of the drafting units or of the pillow blocks on the frames, washers are used between the pillow blocks and the frame, said washers having a thickness sufficient to lift the drafting unit into the desired position. Washers of different thicknesses are selected in order to achieve proper alignment of the drafting units. This type of assembly is time-consuming, since the pillow blocks must be disassembled again if the selection of washers is not correct, and must be assembled again with washers of a different height. Also known is a two-head draw frame, i.e. a draw frame in which two drafting units which are parallel to each other draw fiber slivers. In addition to the alignment of the individual drafting units, similarly as with the single-head draw frame, it is furthermore necessary to align the two parallel drafting units so that they are precisely flush in relation to each other. This is necessary as the two drafting units are generally driven by one single drive so that the drafting rollers of the two drafting units which correspond to each other are rigidly connected to each other. To achieve this rigid connection of the drafting rollers with each other, it is necessary to bring the two drafting units into vertical as well as horizontal alignment with each other, so that the shafts of the drafting rollers may be connected to each other.

OBJECTS AND SUMMARY OF THE INVENTION

It is a principal object of the instant invention to create a process and a device by means of which the assembly of the drafting units of a draw frame can be carried out rapidly, at low cost, and with precise positioning. Additional objects and advantages of the invention will be set forth in part in the following description or may be obvious from the description, or may be learned through practice of the invention.

According to the invention, if the pillow block is placed on a table, and if the height is adjusted by means of a first adjusting device and the table pitch in relation to the frame by means of a second adjusting device, the adjustment of the pillow block of the drafting unit can be effected easily and rapidly. Repeated disassembly of the pillow block in order to insert different washers until the height and pitch of the pillow block in relation to the other components of the draw frame are correct is thus avoided. By adjusting the adjusting devices until the desired position has been achieved, assembly is facilitated considerably.

In an advantageous embodiment, the horizontal alignment of the pillow blocks is adjusted in relation to the table by means of adjusting devices. This has the advantage that the horizontal position of the pillow blocks on the table can be changed after proper position adjustment of the table.

The device according to the invention can be used to special advantage in a process for the adjustment and interconnection of drafting units of a two-head draw frame. If the pillow blocks of the drafting rollers are installed on a table, the height of the table in relation to the frame can be adjusted by means of first adjusting devices, and the vertical alignment of the shafts can be changed by means of second adjusting devices until they face each other in vertical flush adjustment. The desired height of the drafting units is adjusted by means of the first adjusting devices so that the fiber slivers going through the draw frame are transferred to the drafting units and from the drafting units to the components downstream of the drafting units without any deflection away from the components located before the drafting units.

To achieve additional horizontal alignment of the shafts in relation to each other, it is advantageous to adjust the pillow blocks of the drafting units in relation to each other by means of additional adjusting devices until the alignment of the shafts is such that they face each other horizontally. Following this adjustment, the shafts of the drafting rollers can be connected to each other by means of a coupling without tension.

If a table is provided between the pillow blocks and the frame for position adjustment of the pillow blocks on which the drafting rollers of the drafting units are mounted, the adjusting of the pillow blocks can be effected rapidly, easily and precisely. The pillow blocks need not be disassembled for precise position adjustment if the table is connected to the frame by means of adjusting screws.

It is especially advantageous if the height adjustment, as well as the vertical alignment of the pillow blocks, can be carried out with the help of the table. In this manner a precise adjustment of the drafting units, in particular with a two-head draw frame where two drafting units must be aligned with each other, is advantageous.

For horizontal adjustment of the pillow blocks, they are adjusted on the table by means of eccentric collar bolts. The advantage in this method consists in the fact that the vertical alignment of the pillow blocks has already been achieved and only a horizontal adjustment is therefore made by shifting the eccentric collar bolts. By thus separating the horizontal and the vertical adjustability of the pillow blocks, rapid and reliable adjustment of the pillow blocks and thereby of the drafting units is ensured.

It is especially advantageous if the pillow block is equipped with two collar bolt, one being eccentric and the other one round. In this case the pillow block can be swivelled around the round collar bolt by rotating the eccentric collar bolt, so that a good horizontal adjustment of the pillow block on the table is ensured.

Embodiments of the invention are described below through the drawings.

DETAILED DESCRIPTION OF THE PREFERRED EMBODIMENTS

Figure 1:
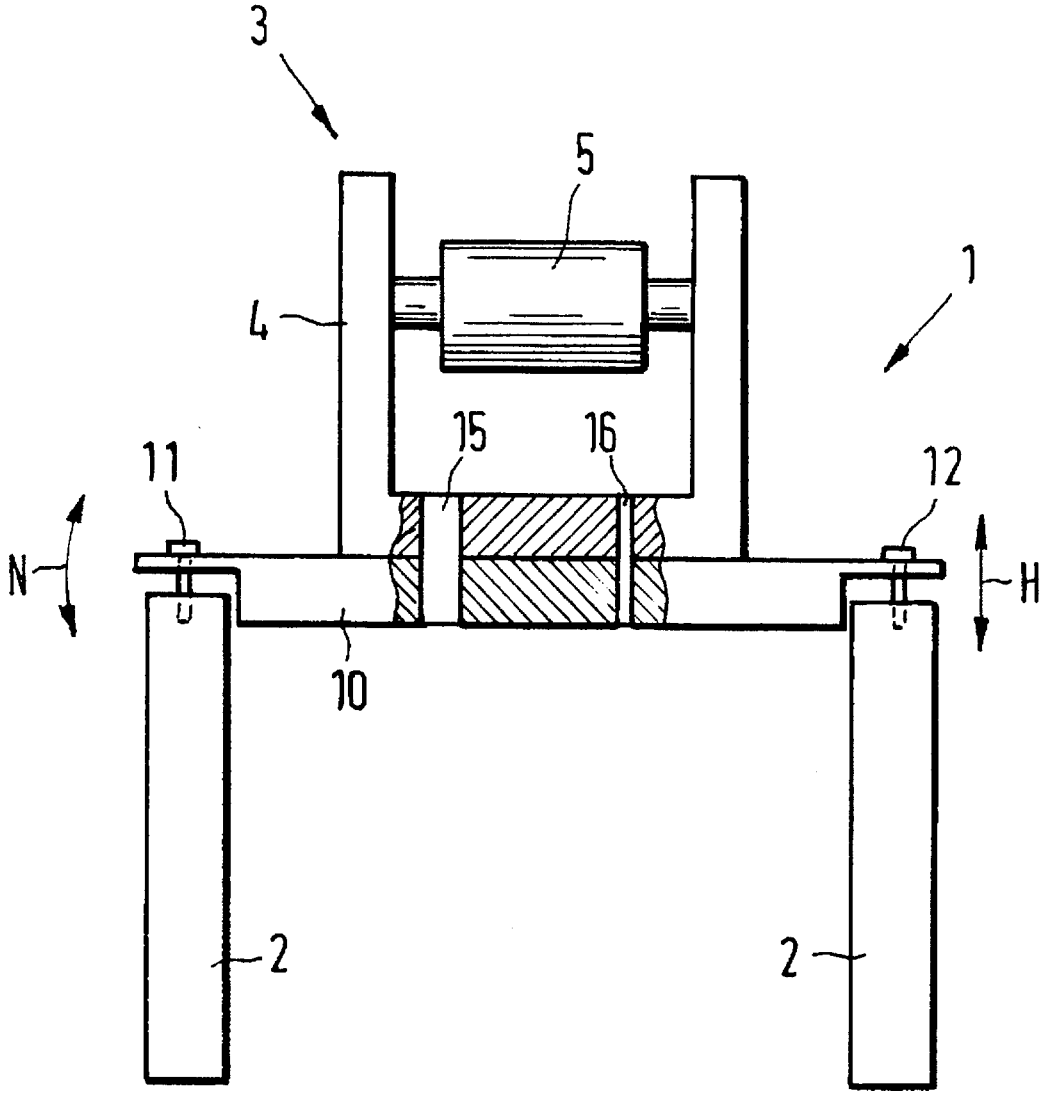
FIG. 1 shows a frontal view of a single-head draw frame.

Reference will now be made in detail to the presently preferred embodiments of the invention, one or more of which are illustrated in the drawings. Each example is provided by way of explanation of the invention, and not a limitation of the invention. The numbering of components throughout the drawings and description with the same components having the same number throughout.

FIG. 1 shows a frontal view of a single-head draw frame 1. The bearing structure of the draw frame 1 is a frame 2. The different operational components of the draw frame 1, such as e.g. control devices, motor, draw-off rollers and fiber sliver depositing devices are installed on this frame 2. In addition, a table 10 is attached on the frame 2, the table 10 supporting a pillow block 4 with drafting rollers 5. The pillow block 4, together with the drafting rollers 5, constitutes a drafting unit 3.

The table 10 is attached to the frame 2 by means of adjusting screws 11 and 12. The drafting unit 3 is adjusted on the table 10 by means of an eccentric collar bolt 15 and a round collar bolt 16. The drafting unit 3 can be furthermore attached to the table 10 by means of screws.

To adjust the height, pitch, and position of the drafting unit 3 in relation to the other components of said drafting unit 3, the following procedure is followed. The frame 2 is anchored to the floor of the shop in which the draw frame is to be set up. Precise height adjustment of the frame 2 is not required here. The precise adjustment is carried out by means of table 10. The table 10 is then used as an adjusting platform for the drafting unit 3. The table 10 is attached to the frame 2 by means of adjusting screws 11 and 12. The table 10 is first moved to the desired height H by means of the setting screw 11. Here it is possible to move the table 10 up or down as indicated by the double arrow H. Using the setting screw 11, the pitch of the table 10 is then adjusted according to double arrow N. The table is here rotatable around a pivot point in the area of the setting screw 11. The rotation can be effected either by means of an articulation which is not shown here, or by winding the table 10. Most often it suffices to carry out this pitch adjustment by winding the table 10.

When the height and the pitch of table 10 has been adjusted, the alignment of the drafting unit 3 in its horizontal position is adjusted. This is done by means of collar bolts 15 and 16. It has been shown to be advantageous for the collar bolt 16 to be round, and the collar bolt 15 to be eccentric. This makes it possible to swivel the drafting unit 3 or the pillow block 4 around the round collar bolt 16 by means of the eccentric collar bolt 15. Precise adjustment of the pillow block 4 is thus easily achieved.

This device according to the invention makes it possible to adjust the drafting equipment easily and rapidly. The position of the drafting unit 3 can be adjusted very precisely without having to undo the attachments again if the position of the drafting unit 3 has proven to be unsuitable after a first adjustment.

Figure 2:
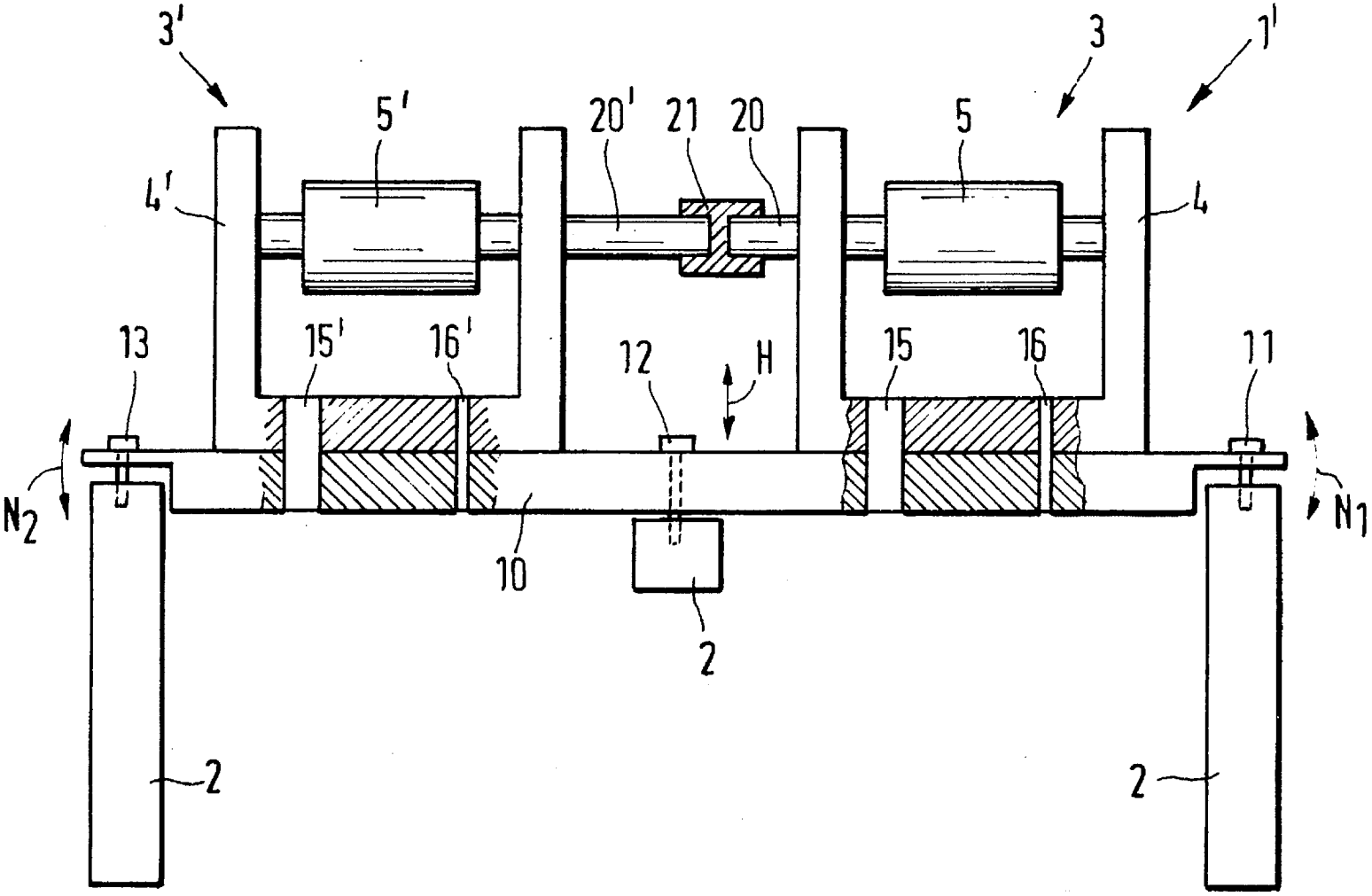
FIG. 2 shows a frontal view of a two-head draw frame.

FIG. 2 shows a two-head draw frame 1' in frontal view. As in the case of the single-head draw frame 1, the draw frame 1' consists of a frame 2, a table 10, drafting units 3 and 3' with pillow blocks 4 and 4' and drafting rollers 5 and 5', as well as of other components not shown here The drafting units 3 and 3' are placed next to each other on the table 10. The drafting rollers 5, 5' are connected to each other via shafts 20, 20' and a coupling 21. Thus it is possible to drive both drafting units 3, 3' with one single motor.

To adjust the drafting units 3, 3' the following procedure is followed. The height of the table 10 and thereby of the drafting units 3, 3' is adjusted by means of the inner adjusting screws 12. By turning the adjusting screw 12 the height of table 10 is changed as indicated by the double arrow H. This is done until the drafting units 3, 3' are at the desired height.

When height H has been reached, the pitch of the drafting units 3, 3' is adjusted. Using the adjusting screws 11 and 13 which are advantageously located as far as possible from the height adjusting screw 12, the pitch of the drafting units 3 in relation to each other is adjusted. By adjusting the adjusting screw 11, the pitch is changed as indicated by double arrow $N_1$ of the drafting unit 3. The adjusting screw 13 produces a pitch as indicated by double arrow $N_2$ of the drafting unit 3'. The change in pitch in either case is effected around a pivot point near the height adjusting screw 12. For this, it is advantageous if the table 10 can be rotated or can at least be slightly twisted in the area of the adjusting screw 12. The adjustment by means of the adjusting screws 11 and 13 continues until the shafts 20 and 20' are precisely and vertically across from each other.

Figure 4A:
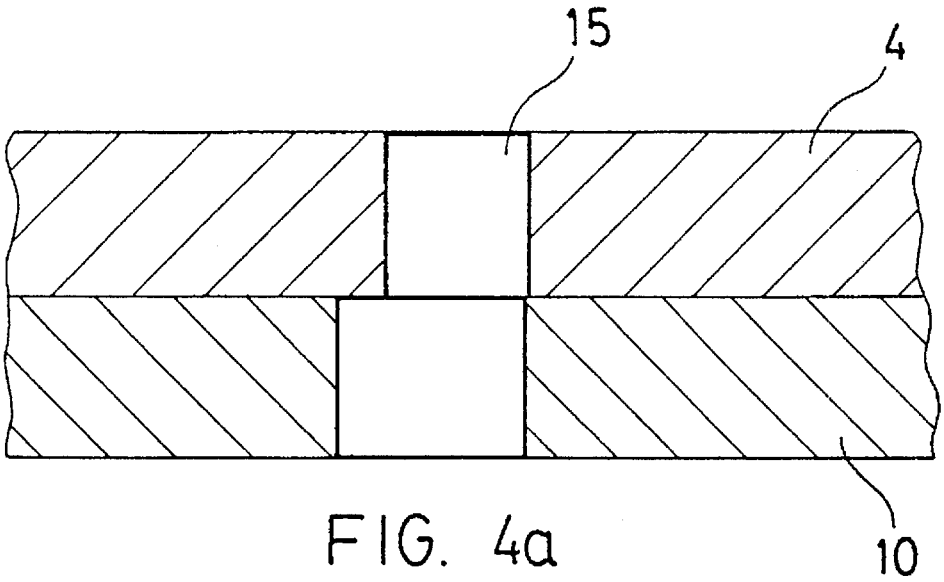
FIG. 4*a* is an enlarged cutaway view of the pillow block and table shown in FIG. 2, particularly illustrating the eccentric bolt.
Figure 4B:
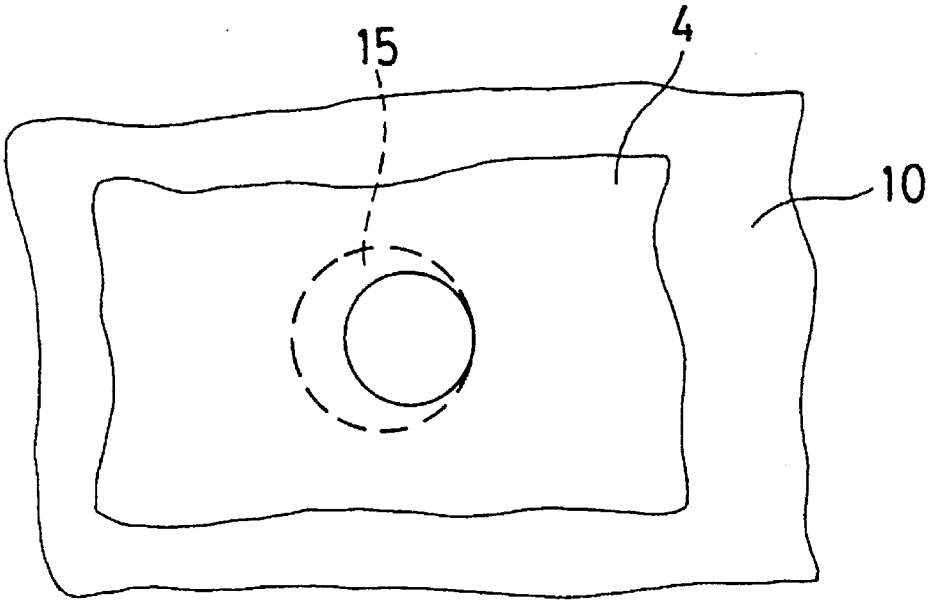
FIG. 4*b* is a top view of the embodiment shown in FIG. 4*a*.

The horizontal coincidence of the shafts 20 and 20' is obtained by means of the collar bolts 15, 16 and 15', 16'. Referring to FIG. 1 and 4*a* and 4*b*, by rotating the eccentric collar bolts 15, 15' the adjustment of the pillow blocks 4, 4' in relation to each other can be effected in such manner that the shafts 20, 20' are flush with each other as they face each other. The rotation of the pillow blocks 4, 4' is produced by a rotation of the eccentric collar bolts 15 and 15' such that the pillow blocks 4, 4' rotate around the round collar bolts 16, and 16'. When the shafts 20 and 20' are flush and precisely across from each other, they can be connected to each other by means of a coupling 21.

The proper positioning of the drafting units 3 and 3' is important in particular with two-head draw frames. For uniform drafting of the fiber slivers it is necessary for the two drafting units 3 and 3' to be driven uniformly. This is only possible if the shafts 20 and 20' face each other in a flush manner and can be connected without offset or pitch of the shaft axes. The device according to the invention and the adjusting process according to the invention make it possible to adjust the two drafting units 3 and 3' precisely and easily. A uniform and good fiber sliver quality can thereby be achieved with a draw frame 1' by using the process and the device according to the invention.

Figure 3:
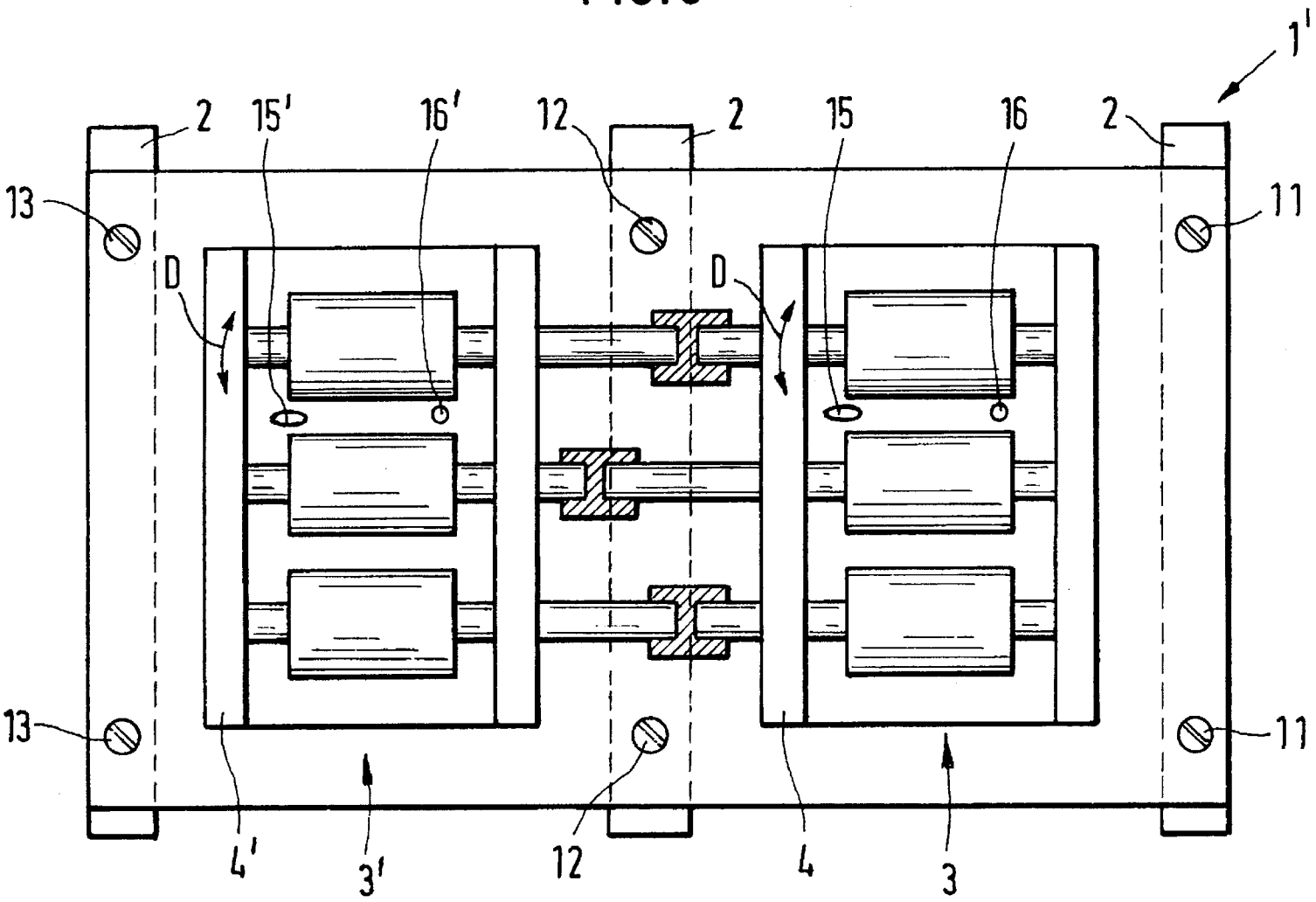
FIG. 3 shows a top view of a two-head draw frame.

To clarify the invention, FIG. 3 shows a top view of the two-head draw-frame 1'. It can be seen in FIG. 3 that the table 10 supports the two drafting units 3 and 3'. Several drafting rollers 5 and 5' are installed in each of the pillow blocks 4 and 4'. Each of these drafting rollers 5 and 5' is connected via shafts 20 and 20' and via a coupling 21 to its corresponding drafting roller.

To ensure the stability of the adjustment of table 10 it is advantageous if two of the adjusting screws 11, 12 and 13 are used in each instance. This minimizes the requirements for precise positioning when assembling the frame 2. The adjustment possibilities of table 10 are again increased thereby, as a pitch adjustment orthogonal to the pitches $N_1$ and $N_2$ is possible.

Referring particularly to FIGS. 3 through 4*b*, it can furthermore be seen from the drawing in FIG. 3 that a swivelling movement of the pillow blocks 4, 4' as indicated by the double arrow D, D' is achieved by means of the eccentric collar bolts 15, 15' and the round collar bolts 16, 16' which serve as pivot points. This makes it possible to adjust the drafting units 3, 3' in relation to each other and thereby also to achieve flush alignment of the shafts 20, 20' in relation to each other.

The invention is not limited to the embodiments shown. In fact, it will be apparent to those skilled in the art that various modifications and variations can be made in the invention without departing from the scope or spirit of the invention. For example, features illustrated as part of one embodiment can be used on another embodiment to yield a still further embodiment. It is intended that the present invention cover such modifications and variations as come within the scope of the appended claims and their equivalents.

We claim:

1. A draw frame, comprising:

a machine frame;

a pillow block supported by said machine frame with at least one drafting unit supported by said pillow block, said drafting unit comprising drafting rollers supported by said pillow block at each end thereof;

a table provided between said pillow block and said machine frame, said table being adjustable relative to said machine frame for adjustment of said pillow block, said pillow block being adjustable relative to said table;

a table adjusting device operably disposed relative to said machine frame and said table to allow for adjustment of said table relative said machine frame; and a pillow block adjusting device operably disposed relative to said pillow block and said table to allow for adjustment of said pillow block relative to said table.

2. The draw frame as in claim 1, wherein said table adjusting device comprises adjusting screws connecting said table to said machine frame, the height of said table relative said machine frame being adjustable through said adjusting screws.

3. The draw frame as in claim 2, wherein said adjusting screws comprise a set of inner adjusting screws configured for adjusting the height of said table relative said machine frame, and a set of outer adjusting screws configured for adjusting the pitch of said table relative said machine frame.

4. The draw frame as in claim 1, wherein said pillow block adjusting device comprises adjusting bolts configured for adjusting the horizontal position of said pillow block relative said table.

5. The draw frame as in claim 4, wherein said adjusting bolts comprise an eccentric collar bolt.

6. The draw frame as in claim 5, wherein said adjusting bolts further comprise a round collar bolt displaced from said eccentric collar bolt, said pillow block being rotatable about said round collar bolt by a degree defined by said eccentric collar bolt.

7. The draw frame as in claim 1, wherein said draw frame comprises a single-head draw frame.

8. The draw frame as in claim 1, wherein said draw frame comprises a two-head draw frame.

9. A draw frame, comprising:

a machine frame;

at least one drafting unit supported by a pillow block on said machine frame, said drafting unit comprising drafting rollers supported at each end thereof by said pillow block;

a table disposed between said machine frame and said pillow block;

adjusting screws connecting said table to said machine frame, said table being adjustable in height relative to said machine frame through said adjusting screws;

a pitch adjusting device configured between said table and said machine frame, said table being adjustable in pitch relative to said machine frame through said pitch adjusting device; and an adjusting device configured between said pillow block and said table, said pillow block being horizontally adjustable relative to said table through said adjusting device.

10. The draw frame as in claim 9, wherein said adjusting device between said pillow block and said table comprises an eccentric bolt by means of which said pillow block is rotatable through a defined arc about a fixed point relative said table.

11. A method for adjusting the drafting unit of a draw frame, the drafting unit being supported on a machine frame by a pillow block and a table disposed between the pillow block and the machine frame, said method comprising:

adjusting the height of the table relative to the machine frame through operation of a variable adjusting device operably configured between the table and the machine frame; and adjusting the pitch of the table relative to the machine frame through operation of a variable adjusting device operably configured between the table and the machine frame.

12. A method for adjusting the drafting unit of a draw frame, the drafting unit including drafting rollers supported on a machine frame by a pillow block and a table disposed between the pillow block and the machine frame, said method comprising the step of horizontally adjusting the position of the pillow block relative to the table through operation of a variable adjusting device operably configured between the pillow block and table.

13. A method for adjusting the drafting unit of a draw frame, the drafting unit being supported on a machine frame by a pillow block and a table disposed between the pillow block and the machine frame, said method comprising:

adjusting the height of the table relative to the machine frame through operation of a variable adjusting device operably configured between the table and the machine frame;

adjusting the pitch of the table relative to machine frame through operation of a variable adjusting device operably configured between the table and the machine frame; and horizontally adjusting the position of the pillow block relative to the table through operation of a variable adjusting device operably configured between the pillow block and table.

14. A method for adjusting the drafting units of a two-head draw frame, the drafting units including interconnectable drafting rollers supported on a machine frame by a pillow block and a table disposed between the pillow block and the machine frame, said method comprising:

adjusting the height of the table relative to the machine frame through operation of a first variable adjusting device operably configured between the table and the machine frame; and adjusting the vertical alignment between the interconnectable drafting rollers through operation of a second variable adjusting device operably configured between the table and the machine frame so that the end faces of the interconnectable drafting rollers are vertically flush with each other.

15. The method as in claim 14, further comprising adjusting the relative horizontal positions of the interconnectable drafting rollers through operation of a third adjusting device operably configured between the pillow blocks and the table until the drafting rollers are horizontally flush with each other.

* * * * *